US010123675B2

(12) United States Patent
Weis et al.

(10) Patent No.: US 10,123,675 B2
(45) Date of Patent: Nov. 13, 2018

(54) TORSION WRINGER

(71) Applicant: Carl Freudenberg KG, Weinheim (DE)

(72) Inventors: Norbert Weis, Weinheim (DE); Uwe Dingert, Abtsteinach (DE); Johannes Hohenhaus, Duesseldorf (DE); Reiner Wallbaum, Duesseldorf (DE)

(73) Assignee: Carl Freudenberg KG, Weinheim (DE)

( * ) Notice: Subject to any disclaimer, the term of this patent is extended or adjusted under 35 U.S.C. 154(b) by 330 days.

(21) Appl. No.: 14/911,732

(22) PCT Filed: Jul. 2, 2014

(86) PCT No.: PCT/EP2014/001811
§ 371 (c)(1),
(2) Date: Feb. 12, 2016

(87) PCT Pub. No.: WO2015/024611
PCT Pub. Date: Feb. 26, 2015

(65) Prior Publication Data

US 2016/0183760 A1 Jun. 30, 2016

(30) Foreign Application Priority Data

Aug. 20, 2013 (DE) ..... 10 2013 013 707

(51) Int. Cl.
*A47L 13/58* (2006.01)

(52) U.S. Cl.
CPC ..... *A47L 13/58* (2013.01)

(58) Field of Classification Search
CPC ..... A47L 13/58
USPC ..... 15/260, 263
See application file for complete search history.

(56) References Cited

U.S. PATENT DOCUMENTS

| | | | | |
|---|---|---|---|---|
| 560,144 | A * | 5/1896 | Moses | A47L 13/58 15/263 |
| 3,406,422 | A * | 10/1968 | Nichols | A47L 13/58 15/263 |
| 5,611,104 | A | 3/1997 | Demars | |
| 6,065,175 | A * | 5/2000 | Tejerina | A47L 13/12 15/116.1 |
| 2002/0066152 | A1* | 6/2002 | Dingert | A47L 13/58 15/260 |
| 2002/0095739 | A1* | 7/2002 | Dingert | A47L 13/58 15/260 |

(Continued)

FOREIGN PATENT DOCUMENTS

| | | | |
|---|---|---|---|
| DE | 102006045615 | B3 | 10/2007 |
| DE | 202013005320 | U1 | 8/2013 |

(Continued)

*Primary Examiner* — Weilun Lo
(74) *Attorney, Agent, or Firm* — Leydig, Voit & Mayer, Ltd.

(57) ABSTRACT

A torsion wringer has a receiving device for receiving the head of a mop, the receiving device having an upper part and a lower part which can be interconnected by elements. The design and to development of the torsion wringer can provide a mop that can be freed from liquid in a problem-free manner. The torsion wringer has elements designed in such a manner and/or are articulated on the parts of the container such that the parts can be rotated with respect to each other.

18 Claims, 4 Drawing Sheets

(56) References Cited

U.S. PATENT DOCUMENTS

| | | | | |
|---|---|---|---|---|
| 2009/0265871 | A1* | 10/2009 | Wooten | A47L 13/20 15/119.1 |
| 2009/0288266 | A1 | 11/2009 | Dingert | |
| 2013/0333152 | A1 | 12/2013 | Shih | |
| 2013/0340199 | A1* | 12/2013 | Tronconi | A47L 13/58 15/260 |
| 2015/0282689 | A1* | 10/2015 | Ngan | A47J 47/18 15/260 |

FOREIGN PATENT DOCUMENTS

| | | | |
|---|---|---|---|
| GB | 411330 | A | 6/1934 |
| TW | 447206 | U | 2/2013 |

* cited by examiner

TORSION WRINGER

CROSS-REFERENCE TO RELATED APPLICATIONS

This application is a U.S. national stage application under 35 U.S.C. § 371 of International Application No. PCT/EP2014/001811, filed on Jul. 2, 2014, and claims benefit to German Patent Application No. DE 10 2013 013 707.1, filed on Aug. 20, 2013. The International Application was published in German on Feb. 26, 2015, as WO 2015/024611 A1 under PCT Article 21(2).

FIELD

The invention relates to a torsion wringer.

BACKGROUND

It is already known from the prior art to expel liquid from a mop by squeezing it out.

The mop head of a mop is received in a receiving device, for example in a sieve on a bucket, and is freed from liquid by being squeezed out.

Here, the user exerts a downwardly directed linear force on the receiving device. The user can achieve this most easily by shifting their weight onto the handle of the mop.

A wringer which operates in accordance with this principle is known from DE 10 2006 045 615 B3. When the base of the receiving device is pressed downward by the mop head of the mop, the receiving device contracts. The mop head is wrung out in this way.

The expulsion of water from the mop head by way of a linearly directed squeezing-out action however necessitates high expenditure of force, and generally leads to unsatisfactory results.

SUMMARY

An aspect of the invention provides a torsion wringer, comprising: a receiving device, configured to receive a mop head of a mop, wherein the receiving device includes an upper part and a lower part, which are connected to one another by one or more connecting elements, wherein the connecting elements are designed, and/or articulated on the upper and lower parts, such that the upper and lower parts are rotatable relative to one another.

BRIEF DESCRIPTION OF THE DRAWING

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
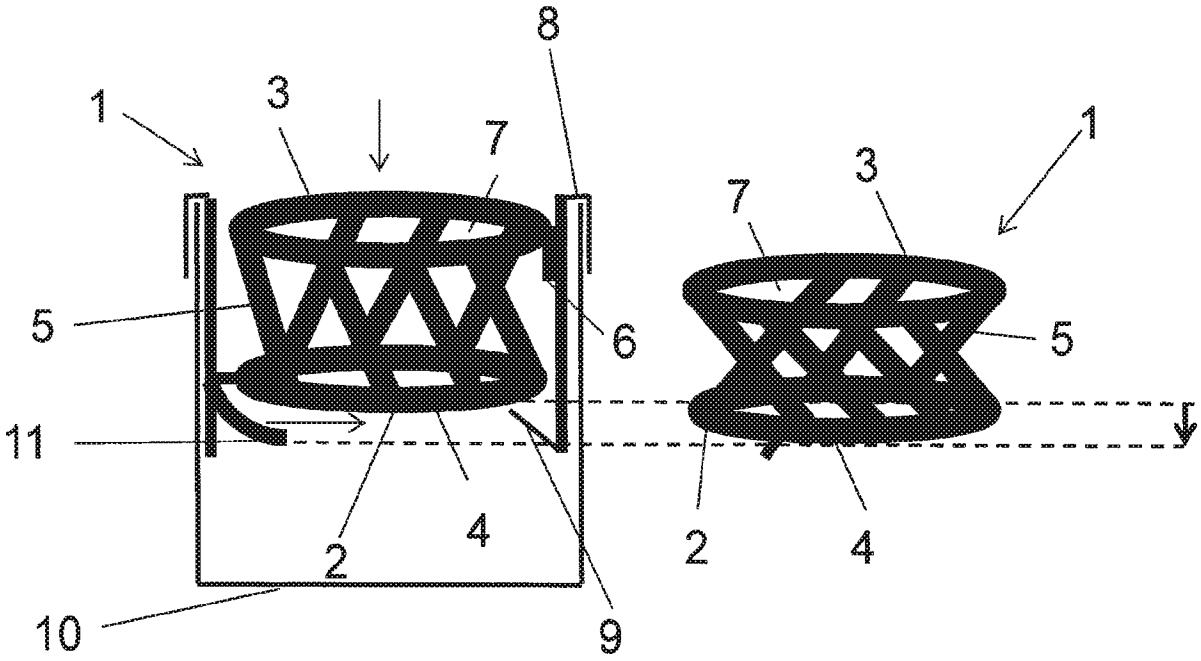
FIG. 1 shows, in the left-hand view, a receiving device for a mop head of a mop, and in the right-hand view, a state of the receiving device in which a lower part has been rotated relative to an upper part.

An aspect of the invention provides a torsion wringer of the type mentioned in the introduction such that, by means of said torsion wringer, a mop can be freed from liquid without problems.

A torsion wringer according to an aspect of the invention comprises a receiving device for receiving a mop head of a mop, wherein the receiving device has an upper part and a lower part which are connected to one another by elements, wherein the elements are designed, and/or articulated on the parts, such that the parts are rotatable relative to one another. According to the invention, it has been recognized that a linear movement of a mop can be utilized to rotate two parts of a receiving device relative to one another. Said rotation is utilized according to the invention to free the mop from liquid. According to the invention, it has also been recognized that the elements can form lateral abutment surfaces for the mop. In this respect, a torsion wringer is designed such that, by means thereof, a mop can be freed from liquid without problems.

One or more of the shortcomings mentioned in the Background can be consequently addressed.

It would be possible for the receiving device to be assigned a guide which, during linear insertion of the mop into the receiving device, rotates one part relative to the other. It is thus possible for a predominantly non-rotational pressure force of the mop on to a receiving device to be converted, by way of suitable guidance of the pressure force, into a rotational movement of one part of the receiving device relative to another part of the receiving device.

Against this background, it would be possible for both parts to be rotatable, and in this case to be rotatable in opposite directions to one another. In this way, the receiving device can be contracted by being guided over only a relatively short movement travel.

It would be possible for the receiving device to be able to be displaced axially as a result of insertion of the mop, wherein the lower part is rotated relative to the upper part as a result of the displacement of the receiving device. In this way, the receiving device as a whole is displaceable in an axial direction, specifically in the direction of a handle of a mop. The upper part is guided linearly, wherein the lower part is rotated, that is to say has a rotation forcibly imparted to it, by way of a thread arc. Also conceivable is a configuration in which the upper part is, by way of a thread turn, guided in an opposite direction to the lower thread turn.

It would be possible for the upper part to be guided linearly in rotationally fixed fashion, wherein the lower part is guided linearly and is simultaneously rotatable.

It would be possible for the elements to be of flexible form. In this way, in the presence of a decreasing action of force, the elements always move the parts back into an initial position. It would be possible for the elements to be composed of an elastomer or of a thermoplastic material.

It would be possible for the elements to be formed in one piece and materially integrally with the parts. This permits inexpensive manufacture.

It is conceivable to use thermoplastic materials or elastomers for the manufacture of the elements and/or of the receiving device as a whole.

It would be possible for the elements to be of lamellar form. Lamellae can be easily deformed.

Against this background, it is conceivable for the elements to serve as restoring springs, by means of which the parts can be at least partially moved into their initial position. By means of this specific embodiment, no separate restoring element is necessary in order to move the parts back to their original spacing when the mop is removed from the receiving device.

It would be possible for at least one element to have at least two sections which transition into one another, or are connected to one another, at a bend point. In this way, the wringing action of the receiving device can be improved.

Against this background, it is conceivable for at least one element to have two sections which are inclined in each case at a different angle with respect to the horizontal or with respect to the parts. By means of this specific refinement, it is possible for one region of the receiving device to impart a more intense wringing action than another.

It would be possible for a mop to be able to be rotated by way of the receiving device. The rotation of the parts of the receiving device advantageously also generates torsion of the mop itself. This has an additional positive effect on the expulsion of water from the mop.

Against this background, it would be possible for the receiving device to have a space which can be reduced in size as a result of rotation of the parts relative to one another. The rotation of the two parts relative to one another results in a decrease in volume of the receiving device, which forces the mop into a space that is decreasing in size. This leads to an effective squeezing action. The space need not be closed off, but rather may have walls with apertures. The walls are preferably formed by the elements.

It would also be possible for the receiving device to be of conical form. In this way, it takes on a funnel shape, whereby a mop can be easily inserted therein.

It would be possible for the receiving device to be able to be returned into an initial position by way of a restoring element. It would be possible for the restoring element to be integrated into a main body of the torsion wringer for coupling to a bucket, and/or into the receiving device. It would be possible for the restoring element to be elastically deformable. It would preferably be possible for the restoring element to be in the form of a spring, in particular a metallic spring or plastics spring. By means of the restoring element, the receiving device is automatically returned into an initial position when the pressure on the mop decreases.

It would be possible for a set to comprise a torsion wringer of the type described here, a mop, in particular a strip mop, and a bucket. A strip mop can be encompassed, and wrung out, by the elements in a particularly effective manner.

The invention described here may be used by consumers or by professional cleaning personnel.

FIG. 1 shows a torsion wringer 1 comprising a receiving device 2 for receiving a mop head of a mop, wherein the receiving device 2 has an upper part 3 and a lower part 4 which are connected to one another by elements 5.

The elements 5 are designed, and/or articulated on the parts 3, 4, such that the parts 3, 4 are rotatable relative to one another.

The elements 5 are movably articulated on the parts 3, 4 and can be pivoted and inclined.

The torsion wringer 1 has a main body 8 which is provided for coupling to a bucket 10. The receiving device 2 is movable relative to the main body 8.

The receiving device 2 can be displaced axially as a result of insertion of the mop, wherein the lower part 4 can be rotated relative to the upper part 3 as a result of the displacement of the receiving device 2.

The receiving device 2 is assigned a guide 6, 11 which, during linear insertion of the mop into the receiving device 2, rotates one part 4 relative to the other part 3.

The upper part 3 is guided linearly by a linear guide 6 and is not rotated, wherein the lower part 3 is rotated by way of a thread arc 11, specifically has a rotation forcibly imparted to it as it slides on the thread arc 11.

Here, the receiving device 2 as a whole is moved by an offset. The offset is schematically indicated by the downwardly directed arrow between the two dashed lines.

In this respect, the guide 6, 11 comprises a linear guide 6 and a thread arc 11.

The elements 5 are of flexible form. The elements 5 are formed in one piece and materially integrally with the parts 3, 4. The elements 5 are of lamellar form.

A mop (not shown) can be rotated by way of the receiving device 2.

The receiving device 2 has a space 7 which can be reduced in size as a result of rotation of the parts 3, 4 relative to one another.

The receiving device 2 can be returned into an initial position by way of a restoring element 9.

Figure 2:
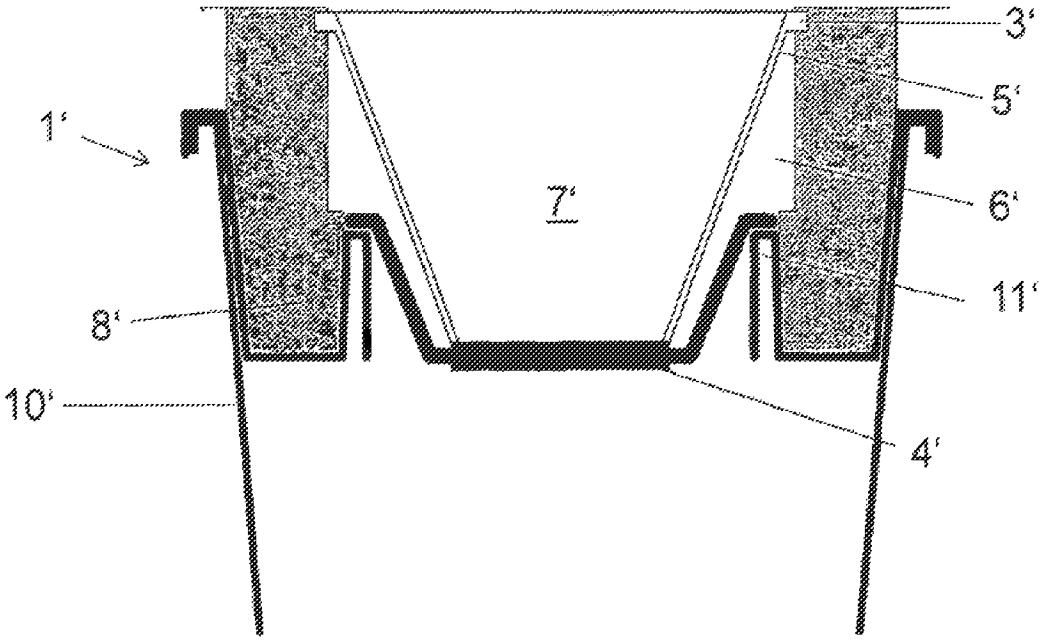
FIG. 2 shows a sectional view of the torsion wringer in which the upper part of the receiving device is guided linearly in rotationally fixed fashion and the lower part is guided linearly and rotatably.
Figure 3:
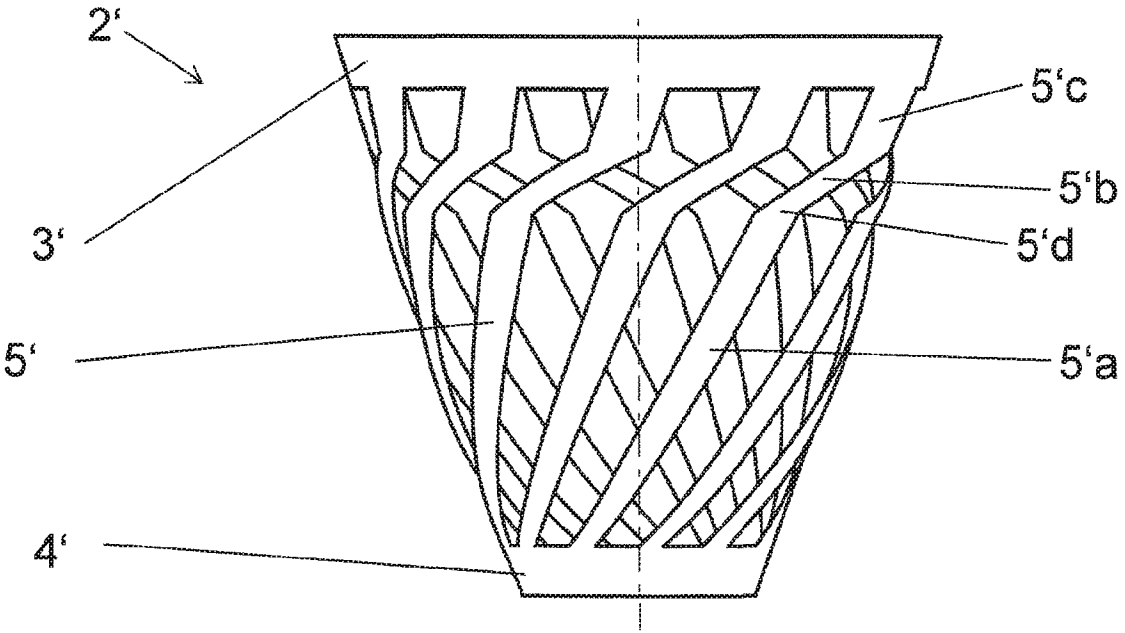
FIG. 3 shows a side view of a basket-like receiving device in which the upper part and the lower part are connected to one another by elements which have in each case three inclined sections.
Figure 4:
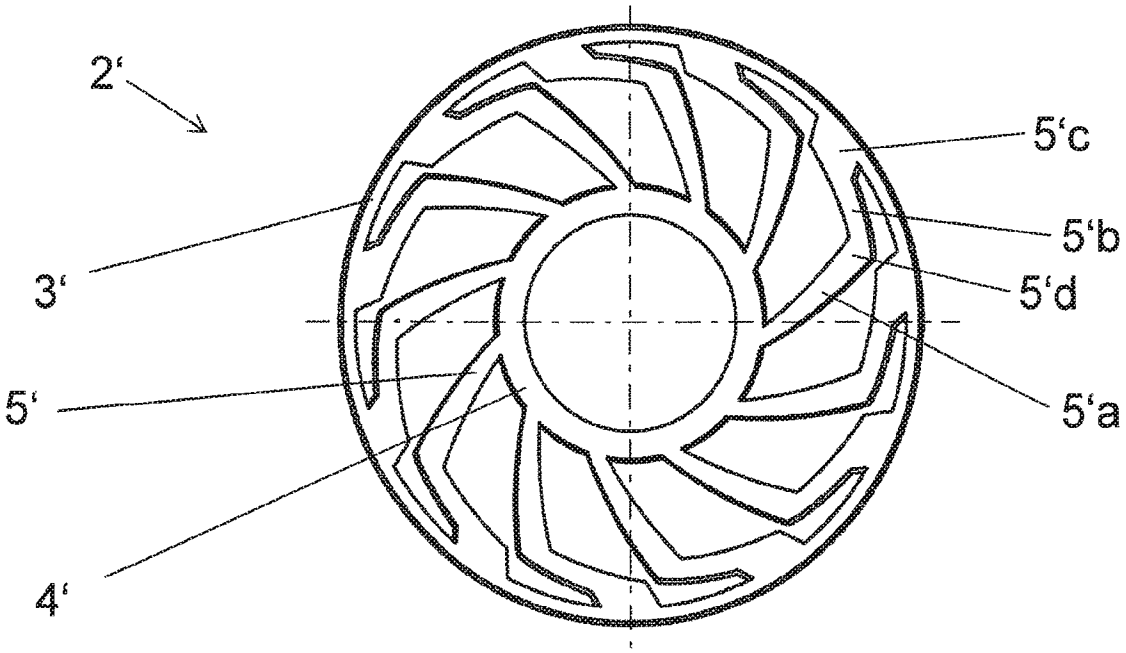
FIG. 4 shows a plan view from above of the receiving device as per FIG. 3.

FIG. 2 shows a torsion wringer 1' comprising a receiving device 2' for receiving a mop head of a mop, wherein the receiving device 2' has an upper part 3' and a lower part 4' which are connected to one another by elements 5', as shown in FIGS. 3 and 4.

The elements 5' are designed, and/or articulated on the parts 3', 4', such that the parts 3', 4' are rotatable relative to one another. The elements 5' are movably articulated on the parts 3', 4' and can be bent and inclined.

The torsion wringer 1' has a main body 8' which is provided for coupling to a bucket 10'. The receiving device 2' is axially movable relative to the main body 8'.

The receiving device 2' can be displaced axially as a result of insertion of the mop, wherein the lower part 4' can be rotated relative to the upper part 3' as a result of the displacement of the receiving device 2'.

The receiving device 2' is assigned a guide 6', 11' which, during linear insertion of the mop into the receiving device 2', rotates the part 4' relative to the other part 3'.

The upper part 3' is guided linearly in rotationally fixed fashion, wherein the lower part 4' is guided linearly and is simultaneously rotatable. The upper part 3' is guided linearly and in rotationally fixed fashion by way of a linear guide 6', is not rotated, and moves downward, wherein the lower part 4' is rotated by way of the rotary guide 11' and is guided linearly downward, specifically has a rotation forcibly imparted to it, which rotation is combined with a linear downward movement.

Here, the receiving device 2' as a whole is moved downward, wherein the space 7' is reduced in size as a result of the simultaneous rotation of the parts 3', 4' relative to one another. A mop (not shown) can therefore be rotated, and wrung out, by way of the receiving device 2.

FIG. 3 shows the basket-like receiving device 2', the upper part 3' of which is in the form of an edge, and the lower part 4' of which is in the form of a base element. The elements 5' are of flexible form. The elements 5' are formed in one piece and materially integrally with the parts 3', 4'. The elements 5' are of lamellar form.

The elements 5' serve as restoring springs by means of which the parts 3', 4' can be at least partially moved into their initial position.

At least one element 5' has at least two sections 5'*a*, 5'*b* which transition into one another, or are connected to one another, at a bend point 5'*d*. At least one element 5' has two sections 5'*a*, 5'*b* which are inclined in each case at a different angle with respect to the horizontal or with respect to the parts 3', 4'.

Specifically, an element 5' is composed of three sections 5'*a*, 5'*b*, 5'*c*, of which, in the initial rest state, each is inclined at a different angle with respect to the upper part 3' or the lower part 4'.

A first section 5'*a*, which is articulated on the lower part 4', is the longest, a second, central section 5'*b* is the second longest, and a third section 5'*c*, which is articulated on the upper part 3', is the shortest. The first section 5'*a* tapers in the direction of the lower part 4'.

FIG. 4 shows a plan view of the receiving device 2' as per FIG. 3.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

The invention claimed is:

1. A torsion wringer, comprising:

a receiving device configured to receive a mop head of a mop, the receiving device including an upper part and a lower part, which are connected to one another by a plurality of connecting elements, the connecting elements being disposed on the upper and lower parts such that the upper and lower parts are rotatable relative to one another; and a guide assigned to the receiving device, the guide being configured to rotate at least one of the upper and lower parts relative to the other during linear insertion of the mop into the receiving device.

2. The wringer of claim 1, wherein the upper and lower parts arc rotatable, and are rotatable in opposite directions to one another.

3. The wringer of claim 1, wherein the receiving device can be displaced axially as a result of insertion of the mop, wherein the lower part can be rotated relative to the upper part as a result of a displacement of the receiving device.

4. The wringer of claim 1, wherein the upper part is guided linearly in rotationally fixed fashion, wherein the lower part is guided linearly and is simultaneously rotatable.

5. The wringer of claim 1, wherein the connecting elements are of flexible form.

6. The wringer of claim 1, wherein the connecting elements are formed in one piece and are materially integral with the upper and/or lower parts.

7. The wringer of claim 1, wherein the connecting elements are of lamellar form.

8. The wringer of claim 1, wherein the connecting elements serve as restoring springs with which the upper and/or lower parts can be at least partially moved into their initial position.

9. The wringer of claim 1, wherein at least one connecting element includes at least two sections which transition into one another, or are connected to one another, at a bend point.

10. The wringer of claim 1, wherein at least one connecting element includes two sections which are inclined in each case at a different angle with respect to horizontal or with respect to the upper and/or lower parts.

11. The wringer of claim 1, configured such that a mop can be rotated by way of the receiving device.

12. The wringer of claim 1, wherein the receiving device includes a space which can be reduced in size as a result of rotation of the upper and/or lower parts relative to one another.

13. The wringer of claim 1, wherein the receiving device is of conical form.

14. The wringer of claim 1, wherein the receiving device can be returned into an initial position by way of a restoring element.

15. A set, comprising:

the torsion wringer of claim 1;

a mop; and a bucket.

16. The wringer of claim 1, wherein the connecting elements are formed in one piece and are materially integral with the upper and lower parts.

17. The wringer of claim 1, wherein the connecting elements serve as restoring springs with which the upper and lower parts can be at least partially moved into their initial position.

18. The wringer of claim 1, wherein at least one connecting element includes two sections which are inclined in each case at a different angle with respect to horizontal or with respect to the upper and lower parts.

* * * * *